US005220309A

United States Patent [19]

Carder, Jr.

[11] Patent Number: 5,220,309

[45] Date of Patent: Jun. 15, 1993

[54] GOALPOST MOUNTED ALARM DEVICE

[76] Inventor: George W. Carder, Jr., 72 Joyce Dr., Pittsburgh, Pa. 15243

[21] Appl. No.: 831,550

[22] Filed: Feb. 5, 1992

[51] Int. Cl.[5] ..... G08B 23/00; A63H 30/00

[52] U.S. Cl. ..... 340/573; 340/326; 340/691; 340/693; 446/175

[58] Field of Search ..... 340/573, 693, 691, 544, 340/565-566, 323 R, 326, 540, 523; 367/198, 188; 446/175; 362/802, 811; 40/902

[56] References Cited

U.S. PATENT DOCUMENTS 3,440,349 4/1969 Gibbs ..... 446/175 X
3,934,148 1/1976 Collins ..... 250/458.1
4,288,784 9/1981 Fusco ..... 340/326
4,346,374 8/1982 Groff ..... 340/573
4,358,754 11/1982 Young et al. ..... 40/902 X
5,051,728 9/1991 Wang ..... 340/573

*Primary Examiner*—Thomas Mullen
*Attorney, Agent, or Firm*—H. Jay Spiegel

[57] ABSTRACT

Disclosed is an alarm device designed to be mounted in pairs on the top of the uprights of a goalpost. Each alarm device includes a sound detector and audible and visual alarms activated responsive to sensing of crowd noise above a predetermined level. The audible and visual alarms may be activated simultaneously or sequentially responsive to different levels of sound pressure.

7 Claims, 3 Drawing Sheets

GOALPOST MOUNTED ALARM DEVICE

BACKGROUND OF THE INVENTION

Devices designed to set off an alarm responsive to sensing of sounds above a desired level are known. Groff U.S. Pat. No. 4,654,642 discloses a tamper proof classroom noise alarm designed to be located within a classroom and to sound an alarm responsive to sensing of noise above a desired level to control the level of background noise and talking within a classroom. The present invention differs from the teachings of Groff as disclosing both audible and visual alarms which are designed to be activated by crowd noise in a stadium.

SUMMARY OF THE INVENTION

The present invention relates to a goalpost mounted alarm device. The present invention includes the following interrelated aspects and features:

(A) In a first aspect, the inventive alarm device is designed to be mounted on a goalpost having at least one ground inserted support, a crossbar connected to the support, and uprights at each end of the crossbar. At the top of each upright, one alarm device in accordance with the teachings of the present invention may be mounted.

(B) Each alarm device may be powered via electrical conductors contained within the uprights, crossbar and support post, which electrical conductors are electrically connected to a remotely located power source. Alternatively, of course, each alarm device may be battery powered.

(C) Each alarm device consists of a sound detector designed to sense levels of sound pressure such as those which would be present in a stadium during an athletic contest such as, for example, a football game. Each alarm device also includes an audible indicator such as, for example, a siren, and a visual indicator such as, for example, flashing lights.

(D) In the preferred embodiment, when the sound detector detects crowd noise above a desired level, the visual and audible detectors are activated simultaneously. In an alternative embodiment, the sound detector may be preset to activate the visual and audible alarms consecutively with one of the alarms being activated responsive to a first sound pressure level and with the second of the alarms being activated responsive to a second pressure level exceeding the first pressure level.

As such, it is a first object of the present invention to provide a goalpost mounted alarm device.

It is a further object of the present invention to provide such a device including a sound detector and indicator means.

It is a yet further object of the present invention to provide such a device having indicator means consisting of audio and visual alarms.

It is a yet further object of the present invention to provide such a device wherein the audio and visual alarms are activated simultaneously when sound pressure exceeds a desired level.

It is a yet further object of the present invention to provide a further embodiment wherein the audio and visual alarms are activated sequentially responsive to different levels of sound pressure.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figures 1, 4:
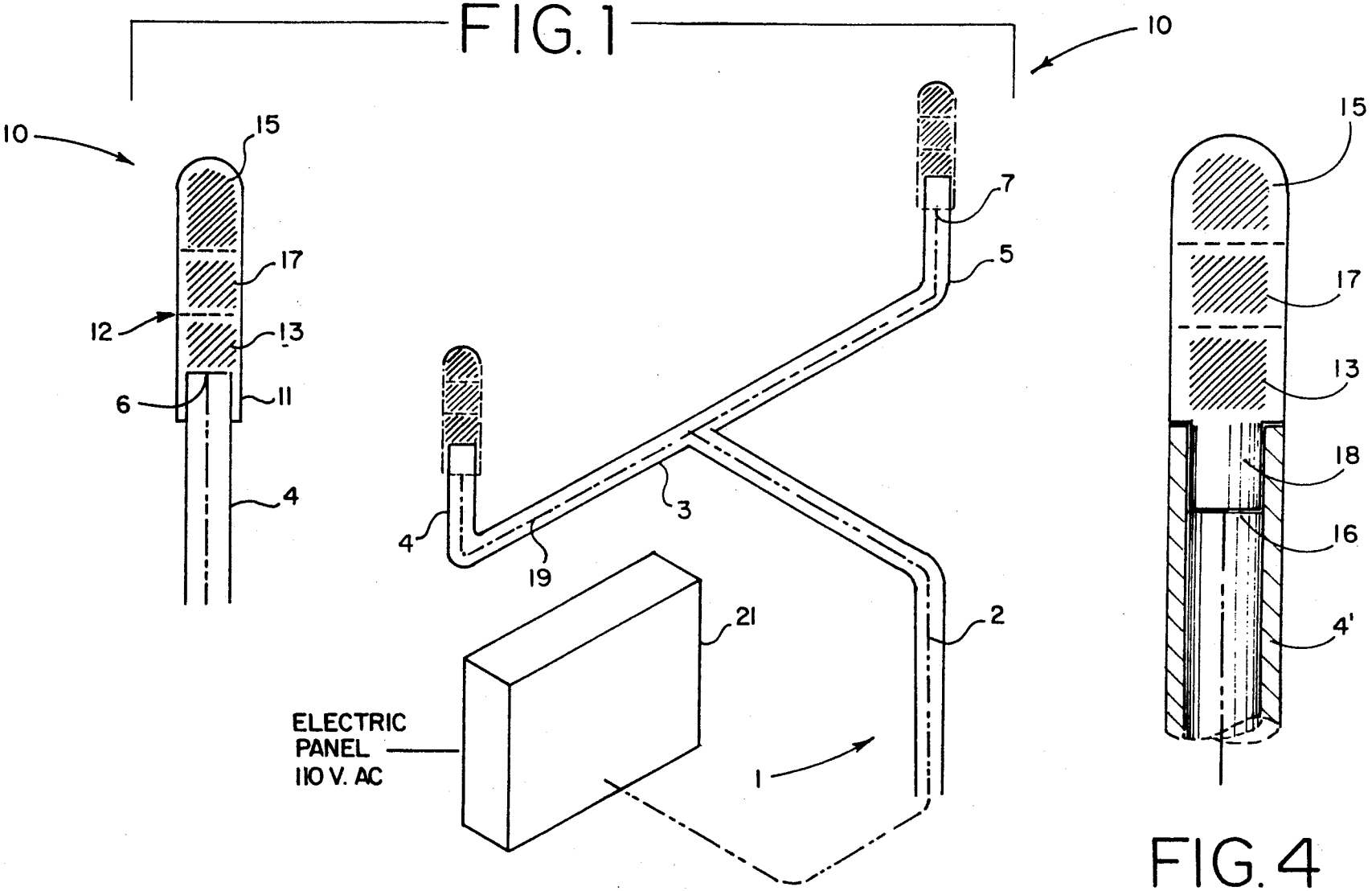
FIG. 1 shows a perspective view of the present invention in its intended environment of use.
FIG. 4 shows an alternative embodiment of attaching the inventive device to a goal post.

With reference, first, to FIG. 1, a goalpost is generally designated by the reference numeral 1 and is seen to include a support post 2 to which is connected a crossbar 3, to which is connected, at each end thereof, uprights 4 and 5. The support post 2, crossbar 3 and uprights 4, 5 are made of hollow pipes and allow electrical conductors to be snaked therethrough.

The upright 4 has a top 6, while the upright 5 has a top 7.

As shown, mounted on the top 6, 7 of each upright 4, 5 are alarm devices which are essentially identical to one another and are each generally designated by the reference numeral 10. To simplify the description, only the alarm device 10 which is mounted on the top 6 of the upright 4 will be described in great detail.

The alarm device 10 is seen to include a sleeve 11 sized and configured to fit over the top 6 of the upright 4 and to be snugly retained thereon. The alarm device 10 includes an audible indicator 13 such as, for example, a horn or siren, a visual indicator 15 such as, for example, continuous, flashing or strobe-type lights, and a found detector 17 provided therebetween. All of these features are preferably contained within an elongated housing 12 which is preferably transparent and which preferably includes a plurality of openings therethrough, such as would be found in a honeycomb-type structure, to allow sounds to reach the sound detector and to allow the audible and visual indicators to be heard and seen, respectively.

An electrical conductor 19 extends from the device 10 to a source of power 21. In FIG. 1, the source of power is shown as a source of Alternating Current. Of course, the subject invention may be battery operated with the battery being located remotely as shown by the power source 21 or, alternatively, with the battery being built into the housing 12.

Figure 2:
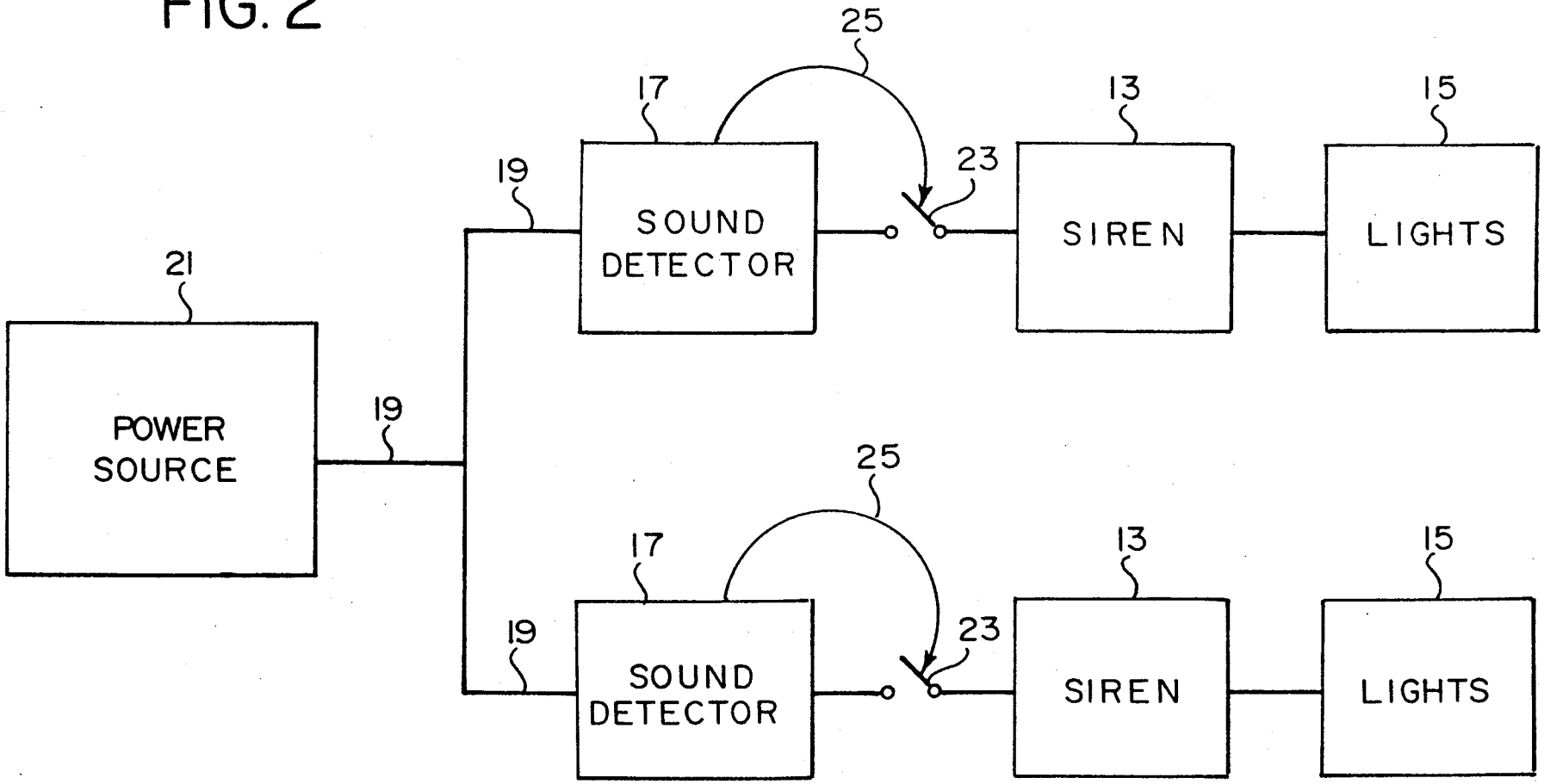
FIG. 2 shows a schematic representation of a first embodiment of electrical circuitry forming a part of the present invention.

With reference, now, to FIG. 2, an example of the electrical circuitry which is used to operate the present invention is shown. The power source is designated by the reference numeral 21, as is the case in FIG. 1, and, as well, the electrical conductor 19 has the same reference numeral. Shown also in FIG. 2 are audible indicators 13 described in the Figure as sirens, and visual indicators 15 described in the Figure as lights. The sound detectors are also designated by the reference numeral 17.

As shown in FIG. 2, each subcircuit controlling audible and visual indicators includes a switch 23 which, when closed, simultaneously activates both the audible indicator 13 and the visual indicator 15 on each upright 4, 5. As further shown in FIG. 2, each sound detector has a control line 25 connected to each switch 23, which control line 25 is intended to carry electrical current only when the sound detector 17 senses sound levels above a desired pre-set level. When sounds exceed such a pre-set level, electrical current will flow in the control line 25 to close the switch 23 and thereby activate the siren 13 and lights 15. One example of the manner of operation of the control line 25 and switch 23 would be for the switch 23 to be of the solenoid actuable type with the control line 25 being electrically connected to the solenoid coil, such that current flowing within the control line 25 will activate the solenoid causing the plunger to reciprocate, thereby closing the switch 23. In such a scenario, the sound detector 17 includes electrical circuitry designed to internally close a switch causing current to flow within the control line 25 responsive to sound levels exceeding a desired pre-set level. Such structure should be understood by those skilled in the art.

Of course, each of the sound detectors 17 may have this type of circuitry and actuation.

Figure 3:
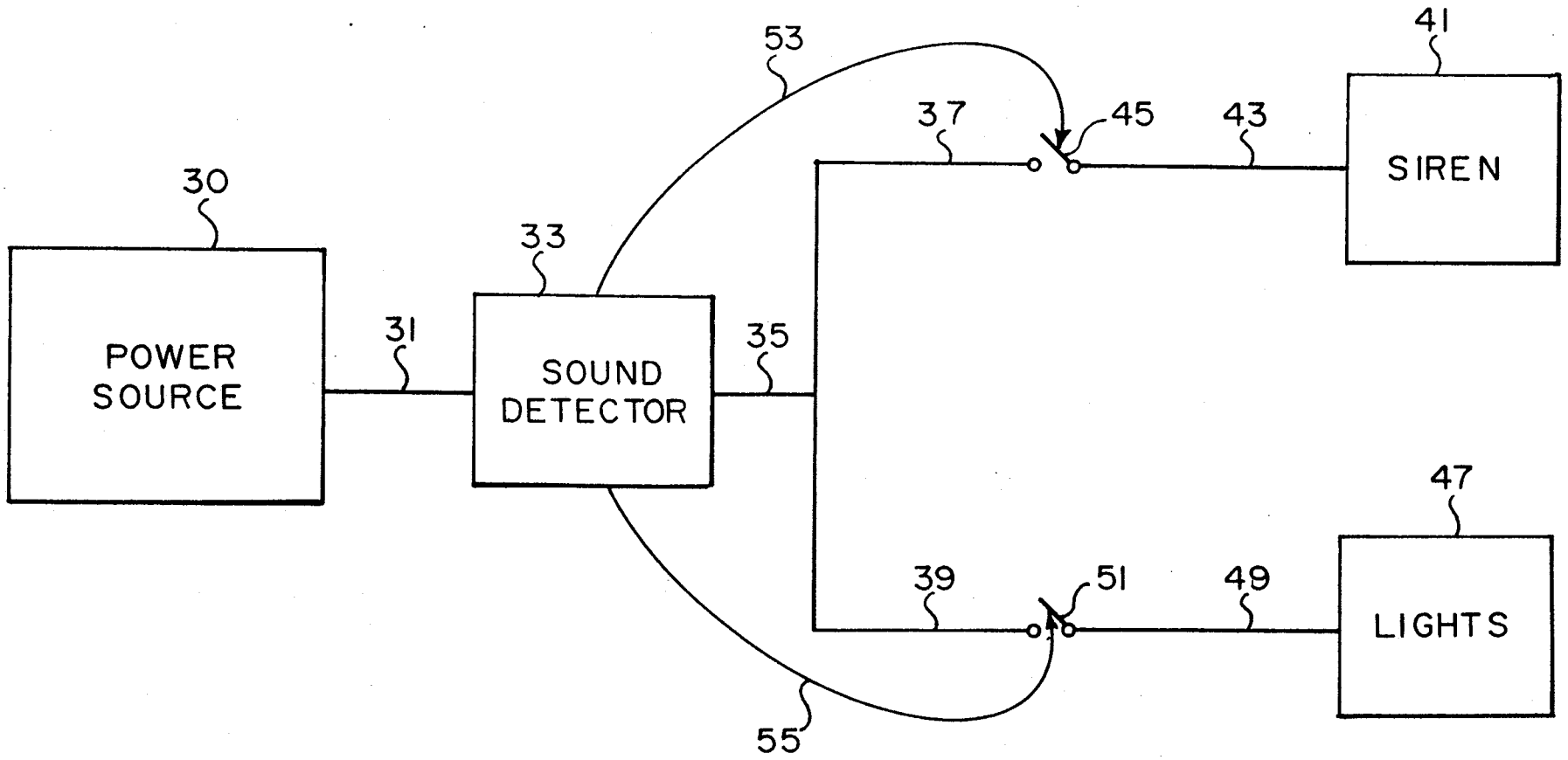
FIG. 3 shows a schematic representation of a further embodiment of electrical circuitry which may be employed in the present invention.

FIG. 3 shows an alternative embodiment of the electrical circuitry of the present invention. For purposes of simplicity, FIG. 3 only shows one of the alarm devices which is mounted on one of the uprights of the goalpost 1. Of course, it should be understood, that similar circuitry would be used for the other alarm device.

The embodiment of FIG. 3 shows a power source 30 connected to a sound detector 33 via electrical conductor 31. Downstream of the sound detector 33, an electrical conductor 35 branches into two parallel conductors 37, 39 with the conductor 37 feeding electrical current to the siren 41 via conductor 43 and switch 45, while the conductor 39 supplies electrical current to the visual indicator 47 via the electrical conductor 49 and the switch 51.

As shown in FIG. 3, the switch 45 is controlled by a control line 53, whereas the switch 51 is controlled by a control line 55. In the embodiment of FIG. 3, the sound detector includes one switch for each of the control lines 53, 55. These switches (not shown) designed to be closed responsive to differing sound pressure levels. Thus, for example, the switch internal to the sound detector 33 which controls flow of current in the control line 53 may be closed responsive to a lower sound pressure level than the sound pressure level which is necessary to close the internal switch in the sound detector 33 controlling flow of current in the control line 55. Thus, in the embodiment of FIG. 3, one of the siren 41 or lights 47 may be activated first with the other of the siren 41 and lights 47 being activated at a later time responsive to an increase in sound pressure level. Of course, the switches 45, 51 may operate in the same manner as described with respect to the switches 23 illustrated in FIG. 2.

In an alternative embodiment, and with reference to FIG. 4, the alarm device 10 may include plug 18 sized and configured to fit into the recess 16 in the goal post 4'.

Two main uses and purposes of the present invention are contemplated by the inventor. In a first use, the inventive alarm devices may be employed by the referees of an athletic contest such as, for example, a football game, to monitor sound pressure levels and to assess penalties when crowd noise exceeds a desired level and exhortations by the referees do not cause the crowd to reduce its sound level.

Alternatively, the inventive alarm devices 10 may be used to encourage crowd noise with spectators knowing that if they yell loud enough or make enough noise, the interesting sirens and flashing lights will be activated, to their delight.

As such, an invention has been disclosed in terms of preferred embodiments thereof which fulfills each and every one of the objects of the invention as set forth hereinabove and provides a new and interesting alarm device designed to be used in conjunction with an athletic contest.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In a goalpost having at least one support post, a crossbar having two ends and first and second uprights extending upwardly from respective ends of said crossbar, each upright having a top support surface, the improvement comprising a crowd noise responsive alarm device mounted on and supported by each respective said top support surface, each alarm device comprising a sound detector and an indicator electrically connected to said sound detector, said sound detector activating said indicator responsive to crowd noise at a sound pressure level exceeding a preset level.

2. The invention of claim 1, wherein each said indicator comprises a visual alarm and an audio alarm.

3. The invention of claim 2 wherein each said visual alarm comprises flashing lights.

4. The invention of claim 3, wherein each said audio alarm comprises a siren.

5. The invention of claim 2, wherein each said sound detector includes means for activating said visual alarm and audio alarm simultaneously.

6. The invention of claim 2, wherein each said sound detector includes means for activating said visual alarm and audio alarm sequentially responsive to differing sound pressure levels.

7. The invention of claim 1, wherein each said alarm device is powered by a source of alternating current.

* * * * *